US005514056A

United States Patent [19]

Ronca et al.

[11] Patent Number: 5,514,056

[45] Date of Patent: May 7, 1996

[54] EXERCISE WEIGHT APPARATUS

[75] Inventors: Dennis Ronca, Phoenixville; David Altopiedi, Broomall, both of Pa.

[73] Assignee: Altoron Inc., Pheonexville, Pa.

[21] Appl. No.: 206,638

[22] Filed: Mar. 7, 1994

[51] Int. Cl.[6] ..... A63B 21/065

[52] U.S. Cl. ..... 482/105; 482/74

[58] Field of Search ..... 482/105, 74

[56] References Cited

U.S. PATENT DOCUMENTS

| | | |
|---|---|---|
| D. 195,134 | 4/1963 | Tarbox . |
| D. 297,658 | 9/1988 | Winston . |
| 332,290 | 12/1885 | Scheurman . |
| 348,379 | 8/1886 | Caesar . |
| 545,879 | 9/1895 | Ericsson . |
| 563,468 | 7/1896 | Fergusson . |
| 721,029 | 2/1903 | Dubler . |
| 941,819 | 11/1909 | Smith . |
| 1,074,939 | 10/1913 | Fredrikson . |
| 1,138,152 | 5/1915 | Saubestre . |
| 1,577,077 | 3/1926 | Ray . |
| 1,729,209 | 9/1929 | Curtice . |
| 2,241,833 | 5/1941 | Waller . |
| 2,882,892 | 4/1959 | Kosior . |
| 2,883,982 | 4/1959 | Rainey . |
| 2,952,459 | 9/1960 | Moffitt . |
| 3,149,839 | 9/1964 | Materia . |
| 3,278,184 | 10/1966 | Rosenbaum . |
| 3,306,610 | 2/1967 | Biggs, Jr. et al. . |
| 3,342,036 | 9/1967 | Gruget . |
| 3,366,380 | 1/1968 | Montour . |
| 3,386,226 | 6/1968 | Code et al. . |
| 3,588,105 | 6/1971 | Donohoe . |
| 3,751,031 | 8/1973 | Yamauchi . |
| 3,759,510 | 9/1973 | Jackson, Jr. . |
| 3,924,851 | 12/1975 | Winston . |
| 3,932,249 | 1/1976 | Jury et al. . |
| 4,180,261 | 12/1979 | Kolka . |
| 4,192,502 | 3/1980 | Owen . |
| 4,258,914 | 3/1981 | Lalli . |
| 4,293,126 | 10/1981 | Havens . |
| 4,303,239 | 12/1981 | Walsh, Jr. . |
| 4,330,120 | 5/1982 | Netti . |
| 4,357,009 | 11/1982 | Baker . |
| 4,369,967 | 1/1983 | Kimura . |
| 4,384,369 | 5/1983 | Prince . |
| 4,384,714 | 5/1983 | Kimura . |
| 4,396,190 | 8/1983 | Wilkerson . |
| 4,407,497 | 10/1983 | Gracie . |
| 4,424,809 | 1/1984 | Yovankin . |
| 4,470,411 | 9/1984 | Hoyt, Jr. . |
| 4,538,812 | 9/1985 | Mugford et al. . |
| 4,621,808 | 11/1986 | Orchard et al. . |
| 4,632,389 | 12/1986 | Moss . |
| 4,789,270 | 12/1988 | Selisky . |
| 4,838,546 | 6/1989 | Winston . |
| 4,905,991 | 3/1990 | Alston . |
| 4,923,418 | 5/1990 | Hoffman . |
| 4,966,365 | 10/1990 | Winston . |
| 4,974,398 | 12/1990 | Kaski . |
| 4,997,183 | 3/1991 | Winston . |
| 5,050,870 | 9/1991 | Pollock . |
| 5,075,902 | 12/1991 | McReynolds et al. . |
| 5,106,082 | 4/1992 | Moschetti et al. . |
| 5,109,546 | 5/1992 | Dicker . |
| 5,115,627 | 5/1992 | Scott . |
| 5,120,288 | 6/1992 | Sinaki . |
| 5,127,891 | 7/1992 | Winston . |
| 5,144,694 | 9/1992 | Da oud et al. . |
| 5,162,027 | 10/1992 | Robinson . |
| 5,162,032 | 10/1992 | Dohner . |
| 5,169,364 | 12/1992 | Donaldson . |
| 5,169,371 | 12/1992 | Holmes . |
| 5,176,600 | 1/1993 | Wilkinson . |
| 5,201,074 | 4/1993 | Dicker . |

*Primary Examiner*—Lynne A. Reichard
*Attorney, Agent, or Firm*—Eric A. LaMorte

[57] ABSTRACT

A weight apparatus adapted to be worn on the shank position of either the arm or the leg and the associated method of attaching such a weight apparatus to the body. The weight apparatus includes at least one weight between one half pound and ten pounds. A biasing device is used to bias the weight against the shank portion of the limb. The biasing device biases the weight in a specific orientation whereby the weight is held against the shank in the region where the predominant bone in the shank is most discernable. By biasing the weight in such a position, there is little muscle or tendons disposed between the weight and the bone. As a result, as the muscles and tendons in the shank are flexed, there is little change in the shape of the surface against which the weight rests. As a result, the weight can be worn comfortably in a manner that does not restrict the natural movements of any muscles or tendons within the limb. Additionally, by positioning the weight on a consistent region of the shank, the weight can be firmly retained in one position, despite any movements of the limbs.

6 Claims, 7 Drawing Sheets

EXERCISE WEIGHT APPARATUS

BACKGROUND OF THE INVENTION

1. Field of the Invention

The present invention relates to weights that can be attached to the legs or arms of a person so as to increase the mass of the limb and assist in the development of the muscle groups that act to move the weighted limb. More particularly, the present invention relates to a weight apparatus and associated method for the attachment of a weight to the limb of a person in a manner that does not restrict the movement of any joint or muscle group acting within the limb.

2. Prior Art

The prior art is replete with different weight devices that are designed to be attached to the limb of a person. Such weight devices are commonly used to increase the mass of the legs or arms, thereby aiding in the development of the various muscle groups that act to move the weighted arm or leg. Examples of weight devices that attach to the legs are exemplified by U.S. Pat. No. 4,838,546 to Winston, entitled ANKLE EXERCISE WEIGHT and U.S. Pat. No. 4,997,183 also to Winston, entitled ANKLE WEIGHT EXERCISE DEVICE. In both of the prior art devices, weights are connected to a fabric body, which is then wrapped around the ankle of the user. The problem with such prior art weight devices is threefold. First, the weight device is not positively attached to the leg. Consequently, as the person runs or jumps, the weight device moves on the person's legs, repeatedly striking the foot and ankle, thereby causing bruises, blisters, callouses or other discomfort to the person using the device. Second, since the weight device does not positively engage the leg, the force of gravity pulls the weight device over the ankle. This inhibits the movement of the ankle, thereby reducing the agility of the person wearing the weight device. Third, since prior art weight devices are not firmly affixed to the leg, the weight develops significant momentum as it moves up and down along the leg. The momentum of the weight is experienced by the joints of the knee and the ankle. The repeated stresses created by the momentum of the weight can act to strain ligaments and tendons in these joints, thus causing injury to the person using the weight system. The possibility of injury becomes greater the more forcefully the leg is accelerated. Accordingly, such prior art weights are particularly dangerous for high impact activities or high acceleration activities such as a quick kick used in practicing karate or another martial art.

Similar disadvantages are also experienced when a person wears an arm supported weight device such as that exemplified by U.S. Pat. No. 5,127,891 to Winston, entitled WRIST EXERCISE DEVICE. Such prior art devices do not attach to the arm in a set position, but rather change position on the arm as the arm is manipulated. Furthermore, such prior art devices typically lay over the wrist, thereby significantly restricting the ability of the person wearing the weight to move his/her wrist.

Recognizing the disadvantages of weights that do not stay in a set location, weight devices have been developed in the prior art that positively engage either the shin or forearm thereby preventing the weight device from either moving or restricting the movement of the wrist or ankle. Such prior art weight devices are exemplified by U.S. Pat. No. 4,905,991 to Alston, entitled SWIM WEIGHTS, U.S. Pat. No. 2,241,833 to Waller, entitled EXERCISING MACHINE, U.S. Pat. No. 4,974,398 to Kaski, entitled WEIGHT STRAP FOR A HORSE'S LEG. In these references, weights are attached to a flexible backing. The flexible backing is then wrapped around the forearm or lower leg and is coupled back to itself. The compression created by the flexible backing being wrapped around the limb retains the weights in one set position on the limb.

The disadvantages of prior art weight devices that attach to the forearm or shin, is that they are designed to fit around a static shape. No consideration is given to the fact that a person's lower leg or forearm is comprised of both bone and muscle and as a person exercises and flexes his/her muscles, the shape of the lower leg and forearm change. In prior art weight devices, the weights are typically distributed evenly throughout the weight device. As a result, as the weight device is wrapped around the lower leg, weights completely surround that portion of the limb. Weights are not typically flexible. Therefore, the weights that abut against muscle cannot conform to the muscle as the muscle contracts and relaxes, changing shape. The contact of the relatively rigid weights against the flexible muscle, restricts the muscle and often causes discomfort to the person wearing the weights.

Another disadvantage of weight devices where weights are wrapped completely around a limb, is that it is very difficult to maintain the weight device in a set position on the limb. A weight device that fits snugly around a limb at rest, may become loose as the muscles in the limb flex and the cross section of the limb changes shape. Consequently, such prior art weight devices must typically be tightly wrapped around the limb utilizing an elastic backing that expands and contracts with the muscles. This construction can inhibit proper blood flow and biases the hard weights against the muscles, thereby restricting the muscles, the detriment of which was previously explained. The ability of such prior art weight devices to remain in a set position becomes even more complex depending upon the purposes for which the person is wearing the weight device. For instance, it does not take a large amount of force to maintain a half pound weight on the leg of a person who is leisurely walking. However, it takes a great deal of force to maintain a 2–5 pound weight on the leg of a boxer, gymnast or other person who is engaging in high impact aerobic exercise.

Consequently, there exists a need in the field of weight devices for a weight system where heavy weights can be attached in a set position on a person's forearm or lower leg in a comfortable and non-constricting manner.

The need also exists for a weight device that firmly engages a person's forearm or lower leg and maintains its position despite the anatomical changes that occur as a person is exercising.

Lastly, the need exists for a weight device that attaches to a limb without compromising the flexibility or performance of the limb and maintains the weight device in a set position despite the accelerations of high impact activities.

The present invention fulfills the needs present in the prior art, by providing a unique weight device as defined in the following description and claims.

SUMMARY OF THE INVENTION

The present invention is a weight apparatus adapted to be worn on the shank position of either the arm or the leg and the associated method of attaching such a weight apparatus to the body. The weight apparatus includes at least one weight between one half pound and ten pounds. A biasing means is used to bias the weight against the shank portion of the limb. The biasing means biases the weight in a specific orientation whereby the weight is held against the shank in the region where the predominant bone in the shank is most discernable. For instance, in the leg, the weight is biased against the tibia in the shin. By biasing the weight against the predominant bone, where that bone is most discernable, there is little muscle or tendons disposed between the weight and the bone. As a result, as the muscles and tendons in the shank are flexed, there is little change in the shape of the surface against which the weight rests. This is contrary to the other regions of the shank of a limb that greatly change in shape as the limb is flexed. By positioning the weight in a region of the shank that remains relatively consistent, the weight can be worn comfortably in a manner that does not restrict the natural movements of any muscles or tendons within the limb. Additionally, by positioning the weight on a consistent region of the shank, the weight can be firmly retained in one position, despite any movements of the limbs. The combination of comfortable fit, firm placement and lack of constrictions makes the present invention device ideal for retaining weights on the arms and legs of people who exercise, especially if that exercise is too strenuous for use of the weight systems available in the prior art.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention weight device can be used on either the forearm or lower leg of any person or on the lower leg of an animal, such as a horse, the present invention weight device is especially suitable for use on the shin region of the human leg. Accordingly, the present invention weight device will hereinafter be described in an application on the lower portion of the human leg and will address the advantages associated with such an application.

Figure 1:
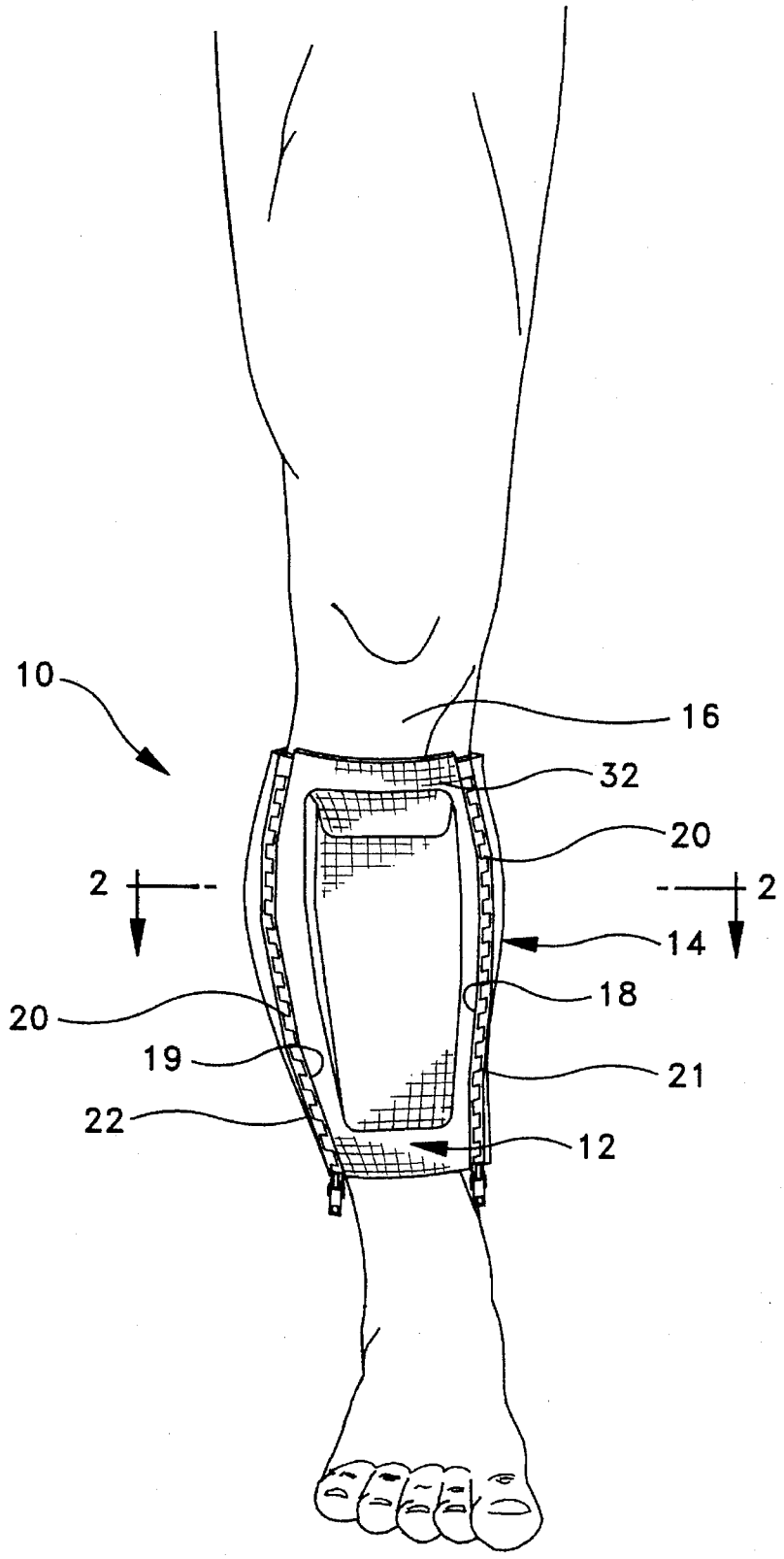
FIG. 1 is a perspective view of one preferred embodiment of the present invention shown in conjunction with the lower leg to facilitate consideration and discussion.

Referring to FIG. 1, there is shown a first embodiment of the present invention weight device 10 having a weight pad 12 removably connected to an elastic support 14. As will be later explained, the weight pad 12 is adapted to fit over the flat face surface of the tibia within the shin 16, wherein the weight pad 12 is biased against the shin 16 and substantially conforms to the contours of the shin 16. The elastic support 14 connects to the distal and proximal side edges 18, 19 of the weight pad 12 and pull the weight pad 12 flush against the shin 16. In the shown embodiment, the weight pad 12 interconnects with the elastic support 14 with the use of zippers 20 that are sewn along the distal and proximal side edges 18, 19 of the weight pad 12 and along the two side edges 21, 22 of the elastic support 14. It should be understood that the use of zippers 20 is merely exemplary and the use of any other detachable fastener such as laces, snaps, buckles or the like may also be used.

The use of a separate weight pad 12 and elastic support 14, as shown in FIG. 1, is desirable in that the weight pad 12 and elastic support 14 can each be separately replaced. All different people have different shaped and sized legs. A person, therefore, may purchase an elastic support 14 that is sized to comfortably fit that person's leg. With the elastic support 14 properly sized for a person's leg, different weight pads 12 can be attached to the elastic support 14 as desired. As will be later explained, weight pads 12 of different masses can all be manufactured with the same general dimensions. As such, weight pads 12 of different masses can each be attached to the elastic support 14 and held on a person's leg in the same manner.

Figure 2:
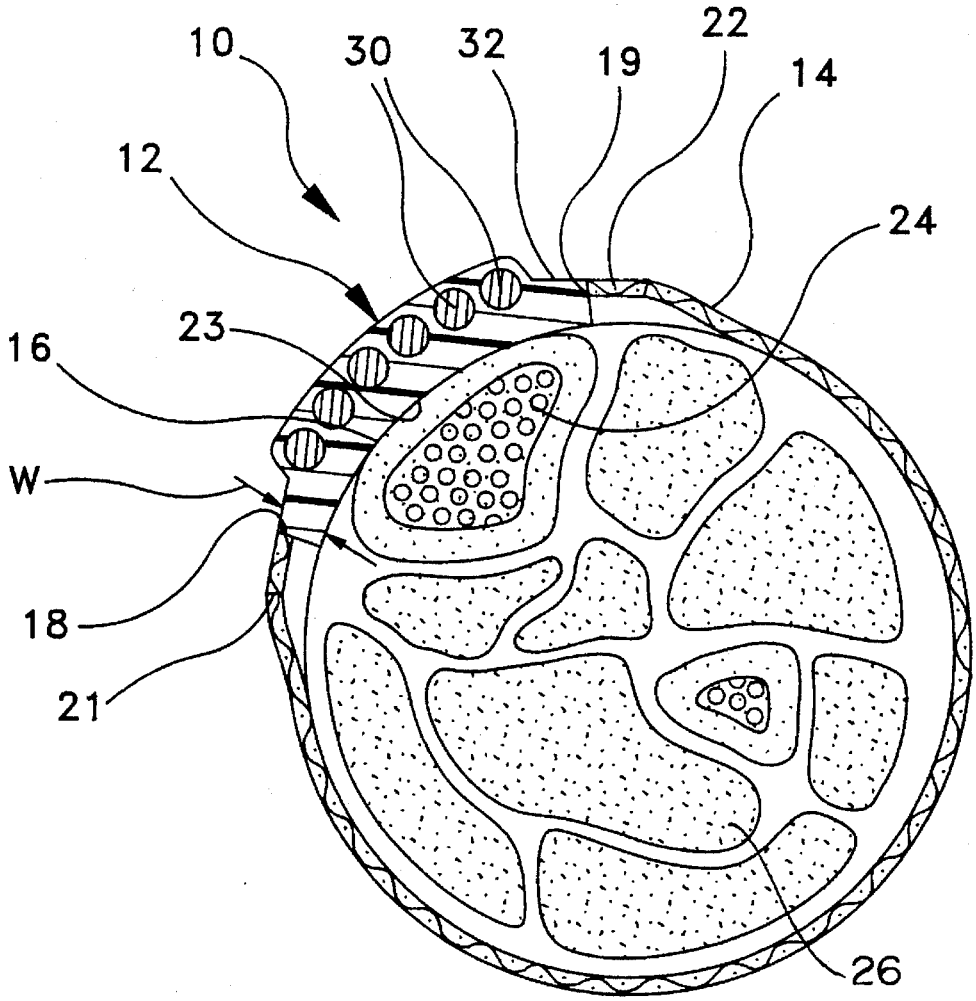
FIG. 2 is a cross-sectional view of the embodiment shown in FIG. 1, viewed along section line 2—2.

Referring to FIG. 2, in conjunction with FIG. 1, it will be seen that as the present invention weight device 10 is attached to a person's lower leg, the elastic support 14 pulls the weight pad 12 flush against the person's shin 16. The shin is the common usage term for the front portion of the lower leg where there is little muscle between the external skin and the flat forward surface 23 of the tibia 24. Although the forward surface 23 of the tibia 24 is partially covered by the tibialius anticus and various other muscles, tendons and ligaments, the shape of this shin region changes very little as the leg moves and the various muscles contract and tendons and ligaments stretch. This is in direct contrast to the calf region 26 of the lower leg which contains the soleus, tibialis posticus, flexor longus digitorum and other major muscles, tendons and ligaments that radically change shape as the leg is flexed.

In FIG. 2 it can be seen that the weight pad 12 is pulled taut over the shin 16 by the elastic support 14. Since the shape of the shin remains relatively constant, the weight pad-to-shin interface remains relatively constant as the leg is flexed. The elastic support 14, however, passes over calf region 26 of the leg that varies widely in shape as the leg is flexed. The elastic support 14 is made of any elastomeric or elastic material that exhibits a high degree of elasticity. As a result, as the calf region 26 of the lower leg changes in shape, the elastic support 14 also changes in shape to instantaneously conform to the changing shape of the calf region 26.

The weight pad 12 is comprised of a flexible backing 32 having side edges 18, 19 that attach to the side edges 21, 22 of the elastic support 14, via the zippers 20. Although the flexible backing 32 can be any flexible material, the flexible backing 32 is preferably made from an elastomeric material with a high degree of elasticity. Such a construction cooperates with the elastic nature of the elastic support 14 to help bias the weight pad 12 against the shin 16 and hold the weight pad 12 in place. In a preferred embodiment, the flexible backing 32 of the weight pad 12 has a width W that provides padding between the leg and the weights 30 that the weight pad 12 supports. In an alternate embodiment, supplemental foam cushioning (not shown) can be attached to the inner surface of the flexible backing 32. As such, the foam cushioning would be juxtaposed between the flexible backing 32 and the shin 16.

In the shown embodiment, multiple cylindrical weights 30 are molded into elastomeric material at positions on the outside of the flexible backing 32 so that the flexible backing 32 is disposed between the weights 30 and the shin 16. The actual weight of the weights to be used in this invention may vary from between one half a pound to ten pounds as desired. The use of cylindrical weights 30 that run longitudinally in the same direction as the tibia 24, allows the weights 30 to substantially conform to the contours of the shin 16. This provides a very comfortable fit and eliminates pressure points between the individual weights 30 and the shin 16. The use of multiple weights 30 also enables the weight pad 12 to conform to the contours of any person's shin no matter the size of that shin or its shape.

Although the embodiment of FIG. 2 shows the weights 30 molded within the elastomeric material of the weight pad 12, it should be understood that other constructions are available. For instance, a pocket could be constructed on the outer surface of the flexible backing 32 into which the weights can be placed. Such constructions are intended to be covered by the scope of this invention, however, the integrally molded weights 30 are specifically shown as an example of the best contemplated mode of construction.

The elastic support 14 firmly biases the weight pad 12 against the shin 16. However, the surface area of the elastic support is relatively large, thereby limiting the pressure by which the elastic support 14 constricts the leg. This construction ensures that the elastic support 14 does not prevent proper blood circulation through the leg. The large surface area also provides a large amount of friction between the elastic support 14 and the leg that ensures that the elastic support 14 and weight pad 12 remain in place despite the most energetic movements of the leg.

The weight pad 12 itself has a long length (see FIG. 1) measured longitudinally up and down the leg. This long length provides a large area for supporting weights and provides a long area of contact between the weight pad 12 and the shin 16. This long area of contact dispenses contact pressures and provides a great deal of friction that helps hold the weight pad 12 in place. Since the weight pad 12 is detachable from the elastic support 14, different weighted weight pads 12 may be selectively worn. The forces retaining the weight pad 12 onto the shin are sufficient enough to hold up to a 15 pound weight in place regardless of how energetically the leg is moved.

Figure 3:
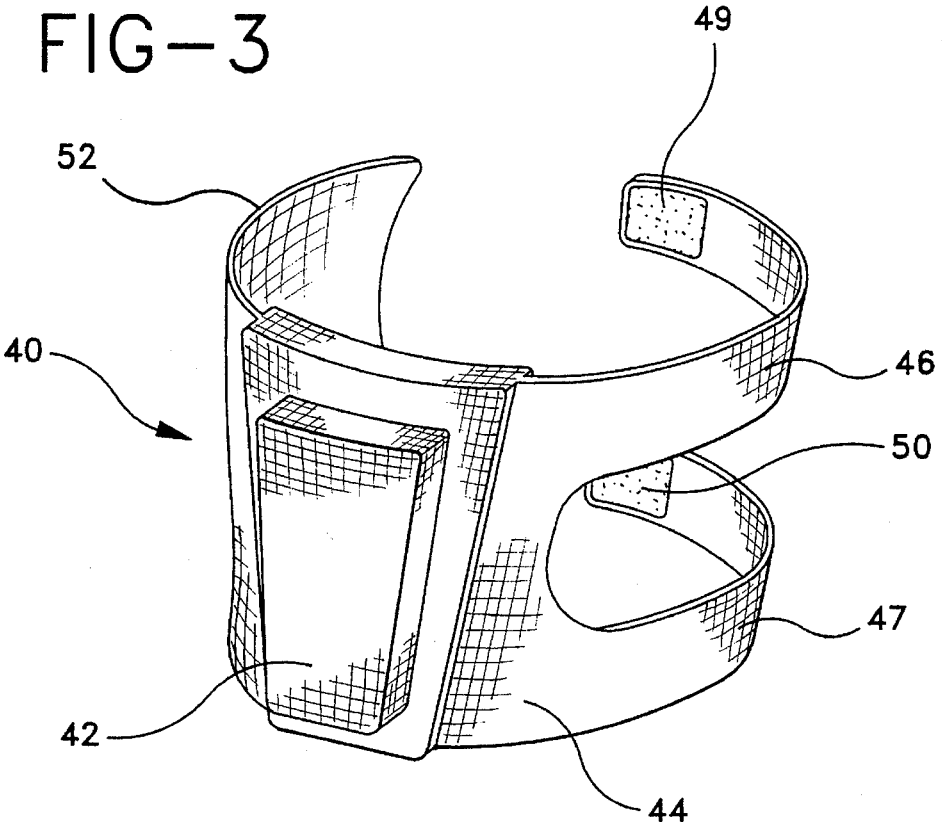
FIG. 3 is a perspective view of a second preferred embodiment of the present invention.

Referring to FIG. 3, there is shown a first alternate embodiment of the present invention weight device 40. In this embodiment, the weight pad 42 is much the same as in the previous embodiments of FIGS. 1 and 2 except that the weight pad 42 is now permanently affixed to the elastic support 44. As such, the weight pad 42 and elastic support 44 are now a single integral unit. The elastic support 44 of the shown embodiment has an upper and lower strap 46, 47. Each strap 46, 47 has a patch of either a hook or loop fastener material 49, 50 proximate their distal ends. The hook or loop fasteners 49, 50 attach to opposite patches of hook or loop fasteners (not shown) that are disposed on a flap 52 of elastic material that extends from the opposite side of the weight pad 42. As a result, the weight pad 42 is positioned over the shin. The upper and lower straps 46, 47 are then wrapped around the calf and attached to the opposite flap 52, thereby holding the weight pad 42 firmly in place.

Figure 4:
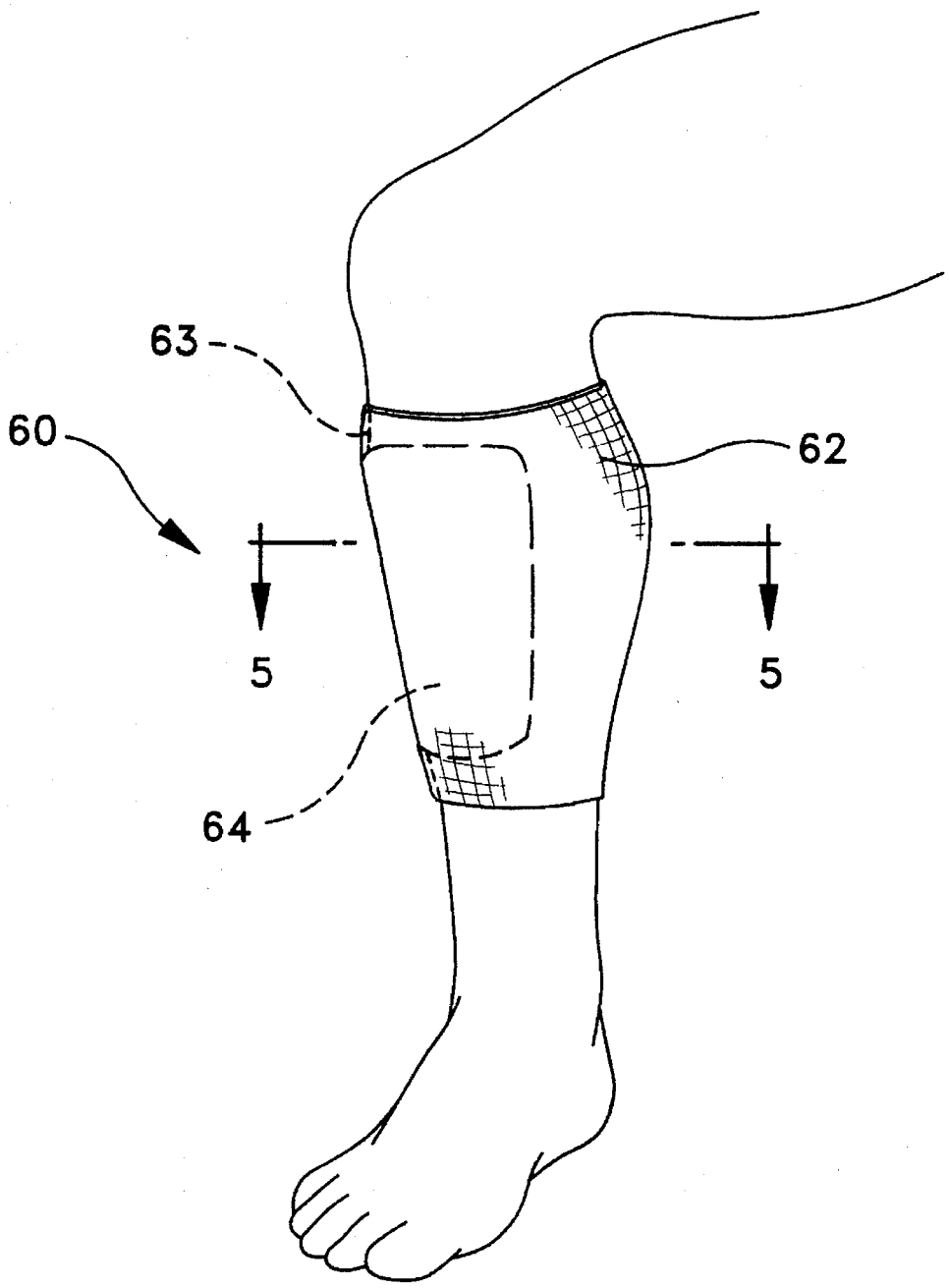
FIG. 4 is a side view of a third preferred embodiment of the present invention shown in conjunction with the lower leg to facilitate consideration and discussion.

Referring to FIG. 4, there is shown a second alternate embodiment of the present invention weight device 60. In this embodiment, a continuous tubular elastic support 62 is used to retain a weight pad 64 against the shin 63. The tubular elastic support 62 is worn by placing one's foot through the tubular elastic support 62 and pulling the support up over the weight pad 64 and the shin 63. The tubular elastic support 62 envelops the entire lower leg in the area of the shin 63. The tubular elastic support 62 is made from either elastic material or is elastomeric, whereby the tubular elastic support 62 compresses the lower leg and conforms to the contours of the lower leg as the leg muscles are flexed.

Figure 5:
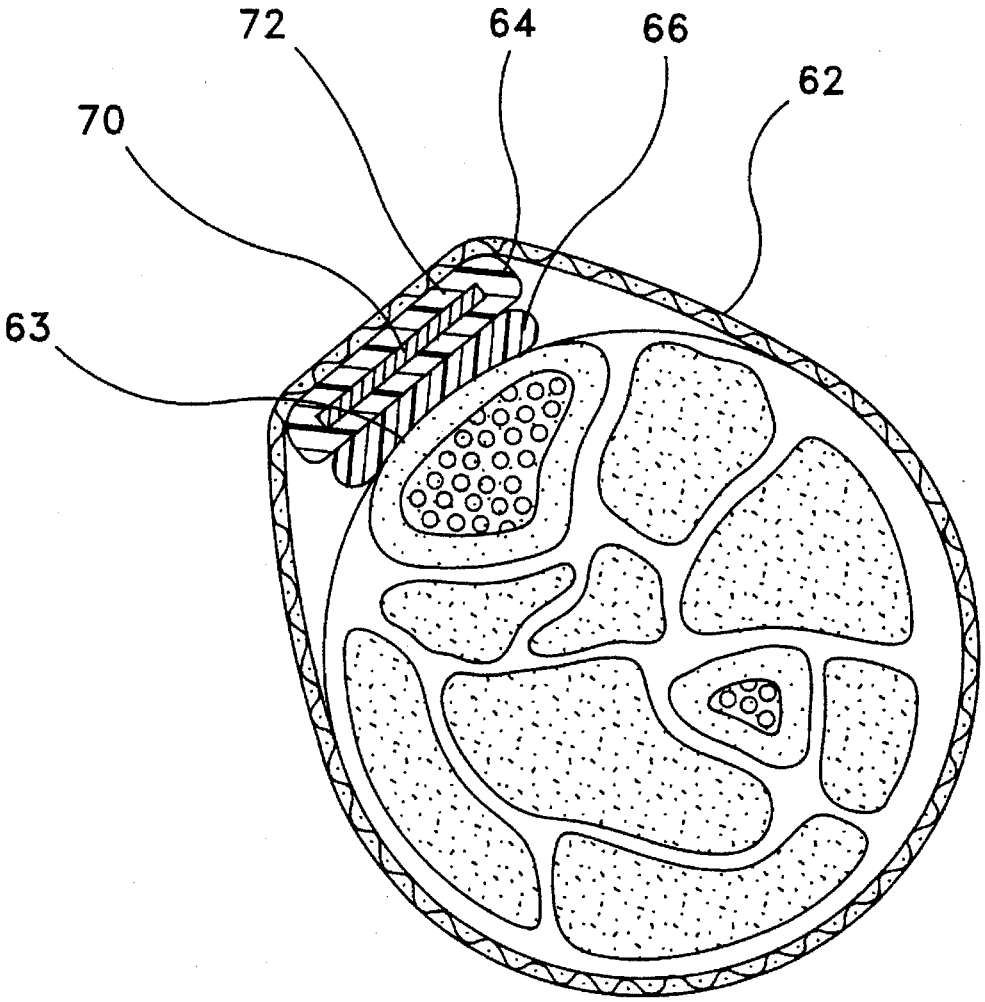
FIG. 5 is a cross-sectional view of the embodiment shown in FIG. 4, viewed along section line 5—5.

Referring to FIG. 5 in conjunction with FIG. 4, it can be seen that the weight pad 64 is placed over the shin 63 before the tubular elastic support 62 is pulled over the weight pad 64 and the corresponding areas of the lower leg. Since the tubular elastic support 62 surrounds the weight pad 64, the weight pad 64 is evenly biased against the shin 63, thereby creating a comfortable fit against the leg. Similarly, since the tubular elastic support 62 envelops the entire region of the lower leg, the compression force is evenly distributed and there is no discomfort created by concentrated loads acting along narrow straps.

In FIG. 5, it can be seen that supplemental padding 66 is disposed between the weight pad 64 and the shin 63. The compression force of the tubular elastic support 62 compresses the weight pad 64 against the supplemental padding 66 and compresses the supplemental padding 66 against the shin 63. The use of supplemental padding 66 is optional. The weight pad 64 may be relatively stiff. As such, it is desirable to cushion the surface of the weight pad 64 that is biased against the shin 63. The desired cushion may be formed as part of the weight pad 64 which will be later explained. However, in the shown embodiment, supplemental padding 66 is added between the weight pad 64 and shin 63. The supplemental padding 66 can be any foam material, soft elastomeric material or other material commonly used to create padding. The supplemental padding 66 would cover the entire interface between the weight pad 64 and shin 63. As such, the supplemental padding 66 may be removably affixed to the weight pad 64 with adhesive, hook and loop fasteners, snaps or the like. Adversely, the supplemental padding 66 may be a separate piece held in place by the compression force of the tubular elastic support 62. By using a separate unit of supplemental padding 66, the weight pad 64 is prevented from actually contacting the leg. As such, only the tubular elastic support 62 and the supplemental padding 66 contact the leg. The relatively light weight tubular elastic support 62 and supplemental padding 66 are far more easily washed and maintained in a sanitary condition than is the heavy weight pad 64. The presence of the padding also acts as a means for compensating for muscle flexure. As the mucsles of the leg expand and contract, the padding contracts and expands thereby helping the elastic support maintain a relative constant force around the leg. Consequently, there are advantages achieved by preventing contact between the weight pad 64 itself and the leg.

The disadvantage of using separate supplemental padding 66 is that it makes the task of orienting the weight pad 64 over both the supplemental padding 66 and the shin 63 slightly more complicated. The weight pad 64 itself may just be formed of metal, wherein the metal weight is placed over the supplemental padding 66 on the leg. However, in a preferred embodiment, the metal weight 70 is molded within an elastomeric casing 72. The elastomeric casing 72 thereby helps cushion the metal weight 70 against the leg and prevents the metal weight 70 from wearing against the tubular elastic support 62.

Figure 6:
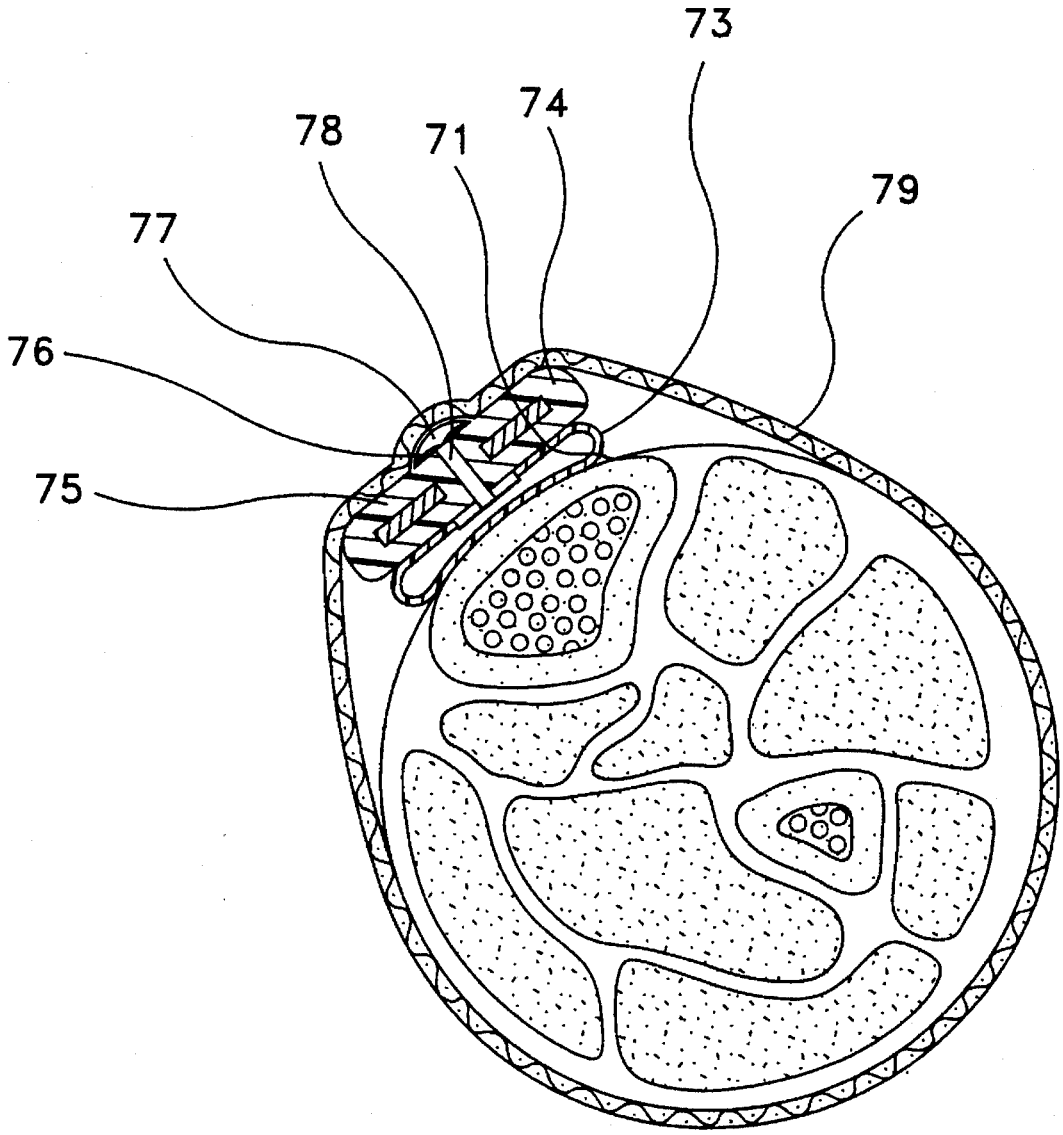
FIG. 6 is a cross-sectional view of a fourth preferred embodiment of the present invention shown in conjunction with the lower leg to facilitate consideration and discussion.

Referring to FIG. 6, an alternate embodiment is shown where an inflatable bladder 73 is disposed between the weight pad 74 and the shin 71. The inflatable bladder 73 takes the place of supplemental foam padding and may be either part of the weight pad or a separate element. In the shown embodiment, the inflatable bladder 73 is part of the weight pad 74. An inflation pump 77 is positioned on the exterior surface 75 of the weight pad 74. A conduit 78 couples the inflation pump 77 to the inflatable bladder 73. The inflation pump 77 includes a one-way valve 76 that enables the inflation pump 77 to fill the bladder 73 with air. A separate deflation valve (not shown) is also provided that enables air to be released from the inflatable bladder 73. As such, it will be understood that by repeatedly depressing the inflation pump 77, the thickness of the inflatable bladder 73 can be increased and the degree of padding between the weight pad 74 and the shin 71 can also be increased.

An elastic support structure 79 is disposed around both the weight pad 74 and the leg as has been described in previous embodiments. However in this embodiment, the elastic support structure 79 may be slightly oversized and may therefore be loose as it is first attached around the leg. The elastic support structure 79 is made taut by pumping air into the inflatable bladder 73. This increases the size of the inflatable bladder 73 which acts to push the weight pad 74 away from the leg and expand the elastic support structure 79. Consequently, a person can create a custom fit and compression force by simply filling the inflatable bladder to his or her liking.

In FIG. 6, a continuous elastic support structure 79 is shown. The elastic support structure 79 passes over the inflation pump 77, thereby allowing the inflation pump 77 to be engaged through the material of the elastic support structure 79. However, it will be understood that an elastic support structure that attaches to the weight pad as in FIG. 1 may also be used, wherein the inflation pump 77 would be directly accessible.

Figure 7:
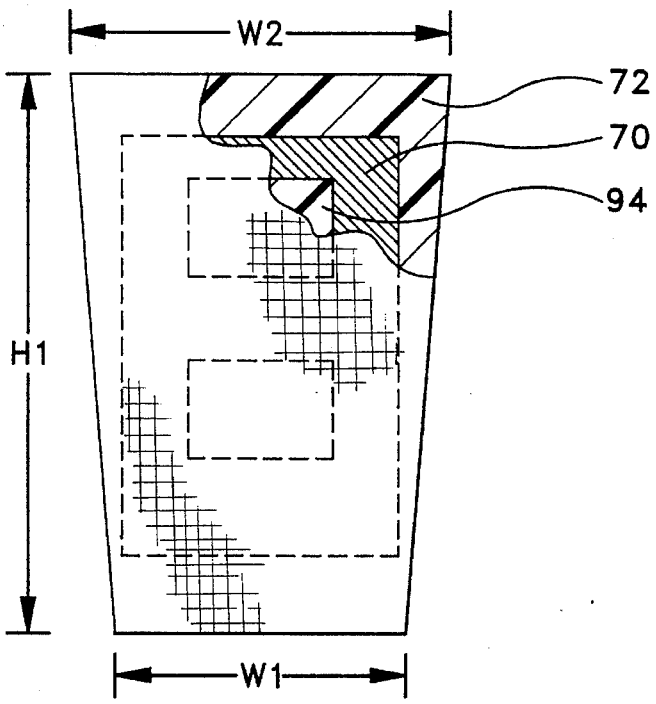
FIG. 7 is a partially segmented forward view of an alternate embodiment of a weight pad as used in accordance with the present invention.

Referring to FIG. 7, it can be seen that the weight pad 64 has a height H1, a top width W2 and a smaller bottom width W1. The dimensions of the height H1 and widths W1, W2 are sized to enable the weight pad 64 to follow the natural taper of the lower leg and press against the shin. In the shown embodiment, the metal weight 70 is molded within the elastomeric casing 72. The metal weight 70 can be unistructurally formed or segmented and is preferably constructed of a highly dense metal such as lead, tungsten or steel. Cavities 94 are defined by the structure of the metal weight 70. By varying the size of the cavities 94, the overall mass of the weight pad 64 can be varied without changing the size of the weight pad 64. As a result, numerous weight pads 64 of varying masses can be created in a single size. Therefore, the elastic support element engages each weight pad 64 in the same manner despite the differences in mass between the various weight pads. A person can therefore use the same elastic support element with any number of different weight pads and the fit of each weight pad against the shin would be identical. This provides a much simpler means for changing weights than prior art systems where individual weights must be added or removed from a common device, whereby the size and shape of the device changes with each change in weight.

Although metal weights are shown, it will be understood that plastic weights or metal impregnated plastic weights may also be used. Metal weights were described as being the most cost effective manner of producing the present invention with a significant mass.

Figure 8:
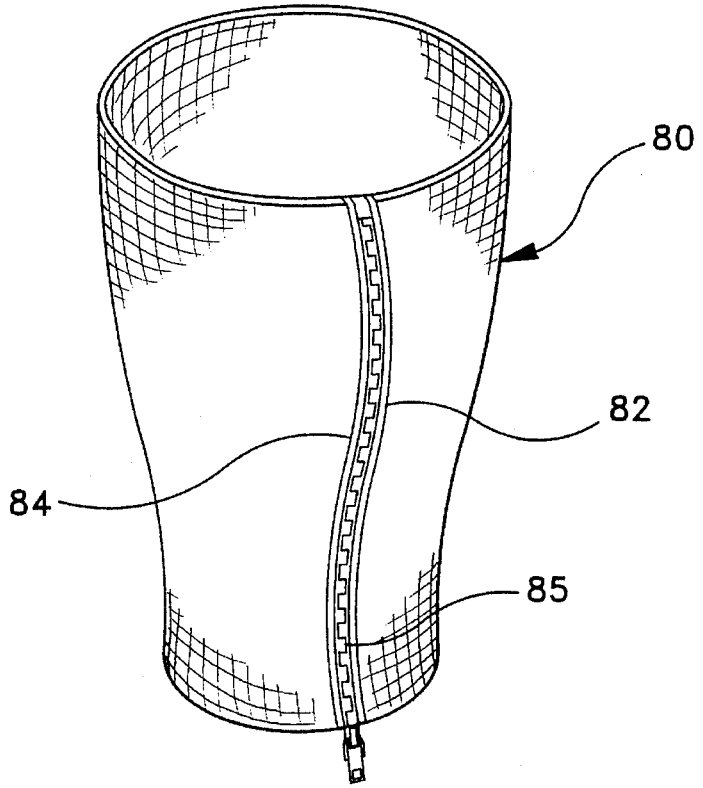
FIG. 8 is a front view of an alternate embodiment of an open-ended compression sleeve as used in accordance with the present invention.

Referring to FIG. 8, there is shown an alternate embodiment for a tubular support structure 80. In the shown embodiment, the tubular support structure 80 is not continuous, but rather has a first end 82 and a second end 84. A zipper 85 is disposed between the first end 82 and second end 84, wherein the first end 82 can be selectively joined to the second end 84 to create a continuous structure. The shown support structure 80 is used in the same manner as was the support structure shown in FIGS. 4 and 5. However, in the shown embodiment, the support structure 80 need not be pulled up over the leg. Instead, the support structure can be wrapped around the leg over a weight pad and the two ends 82, 84 of the support structure 80 can be joined. Once the ends 82, 84 are joined, the support structure compresses the lower leg and biases the weight pad against the bone in the shin as previously explained.

Figure 9:
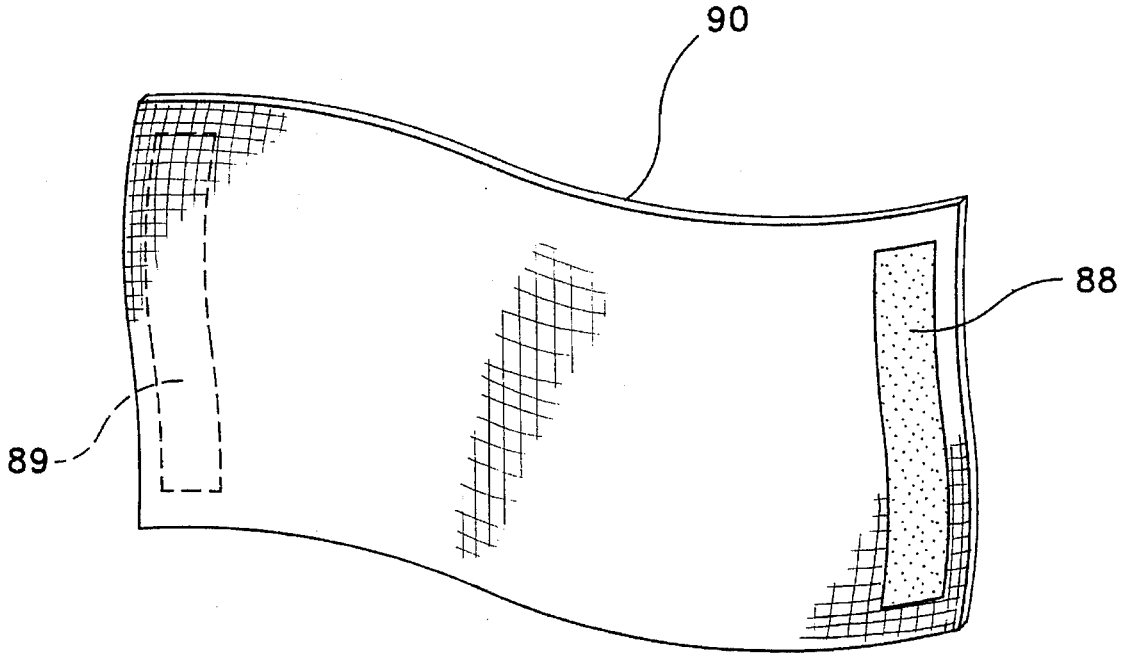
FIG. 9 is a perspective view of a second alternate embodiment of an open-ended compression sleeve as used in accordance with the present invention.

The shown use of the zipper 85 is of course exemplary and any other attachment means can be used. For example, in FIG. 9 the zipper of the previous embodiment is replaced by patches 88, 89 of hook and loop fasteners. In this embodiment, the support structure 90 is wrapped around the weight pad and the leg until the hook and loop fasteners 88, 89 engage and create the desired tubular support structure. By utilizing large patches of hook and loop fasteners 88, 89, the support structure can be adjusted to various sizes when wrapper around the leg, thereby providing a degree of adjustability not present in the previous embodiment of FIG. 8.

It will be understood that the present invention weight apparatus described in conjunction with the various drawings are merely exemplary and a person skilled in the art of biomechanical devices may make numerous variations and modifications to the shown embodiments utilizing functionally equivalent components to those described. More specifically, it will be understood that any biasing means can be used to hold the weight pad in place provided the weight pad is biased against the predominant bone in either the forearm or the shin. Similarly, any combination of disclosed features can be used to create embodiments not specifically described. All such variations and modifications are intended to be included within the scope of the invention as defined by the appended claims.

What is claimed is:

1. A weight apparatus to be worn on the lower leg proximate the shin region where the tibia is discernable through the skin, said weight apparatus comprising:

a single weight pad unit between one-half pound and ten pounds, said weight pad unit having two side edges and a contact surface disposed between said side edges;

at least one band of elastic material that is selectively attachable to at least one of said side edges of said weight pad unit, said at least one band of elastic material and said weight pad unit being configurable into a circular configuration through which the lower leg can pass, wherein said at least one band of elastic material is adapted to bias said weight pad unit against said lower leg, whereby said contact surface of said weight pad unit is held in abutment against said shin region.

2. The weight apparatus accordingly claim 1, wherein said weight pad unit includes at least one weight and padding disposed between said at least one weight and said contact surface.

3. The weight apparatus according to claim 2, wherein said at least one band of elastic material consists of a single band of elastic material having an opposite first end and second end.

4. The weight apparatus according to claim 3, further including a first fastening means disposed proximate said first end of said band and a second fastening means disposed proximate said second end of said band, wherein said first end and second end of said band can be selectively joined to said side edges of said weight pad unit thereby forming said circular configuration.

5. The weight apparatus according to claim 1, wherein said weight pad unit includes a plurality of weights, said plurality of weights being adapted to generally conform to the contours associated with the shin region as said weight pad unit is biased against the shin region.

6. The weight apparatus according to claim 1, wherein at least one weight is enveloped within elastomeric material, whereby the elastomeric material provides padding between said at least one weight and said contact surface.

* * * * *